US005983066A

United States Patent [19]

Abe et al.

[11] Patent Number: 5,983,066

[45] Date of Patent: Nov. 9, 1999

[54] IMAGE FORMING APPARATUS

[75] Inventors: Takashi Abe; Hiroaki Fujikura; Shinji Hozumi, all of Ebina, Japan

[73] Assignee: Fuji Xerox Co., Ltd., Tokyo, Japan

[21] Appl. No.: 09/184,049

[22] Filed: Nov. 2, 1998

[30] Foreign Application Priority Data

Dec. 11, 1997 [JP] Japan ..... 9-341058

[51] Int. Cl.[6] ..... G03G 15/00

[52] U.S. Cl. ..... 399/394; 271/270; 399/388; 399/396

[58] Field of Search ..... 399/388, 390, 399/394, 396, 301, 43; 271/226, 227, 242, 264, 265.01, 265.02, 270

[56] References Cited

U.S. PATENT DOCUMENTS

| | | | |
|---|---|---|---|
| 4,129,377 | 12/1978 | Miyamoto et al. | 399/388 X |
| 4,799,084 | 1/1989 | Koike et al. | 399/394 |
| 4,823,159 | 4/1989 | Yamamoto et al. | 399/394 |
| 5,008,710 | 4/1991 | Kobayashi et al. | 399/394 X |
| 5,043,771 | 8/1991 | Shibata et al. | 399/396 |
| 5,482,265 | 1/1996 | Nakazato et al. | 271/242 |
| 5,543,909 | 8/1996 | Quesnel | 399/394 |

*Primary Examiner*—Arthur T. Grimley
*Assistant Examiner*—Sophia S. Chen
*Attorney, Agent, or Firm*—Oliff & Berridge, PLC

[57] ABSTRACT

An image forming apparatus includes an image transfer unit disposed along a sheet feed path. A sheet feed roller feeds a sheet toward an image transfer position where an image can be transferred by the image transfer unit. A sheet detect unit detects the sheet fed by the sheet feed roller and a control unit controls the rotational operation of the sheet feed roller in accordance with a detection result of the sheet detect unit. As such, a sheet feed path length, which extends between the image transfer position and a detection position where the sheet is detected by the sheet detect unit, is set at an integer multiple of a circumferential length of the sheet feed roller.

7 Claims, 3 Drawing Sheets

IMAGE FORMING APPARATUS

BACKGROUND OF THE INVENTION

1. Field of the Invention

The present invention relates to an image forming apparatus using an electrophotographic system and, in particular, to an image forming apparatus including a sheet feed roller for feeding a sheet toward the transfer position of an image.

2. Description of the Related Art

Generally, in an image forming apparatus using an electrophotographic system, an electrostatic latent image corresponding to an image signal is formed on a photosensitive material and is then developed to thereby produce a toner image, the toner image is transferred to a sheet and, after then, the toner image on the sheet is fixed.

Also, among the image forming apparatus of this type, there is known an image forming apparatus employing a feed system in which a sheet is fed to the transfer position of a photo sensitive material or an intermediate transfer material by a regi-roller provided on this side (upstream side of sheet feeding).

In particular, in the image forming apparatus employing the above-mentioned feed system, the sheet fed from the upstream side of the sheet feeding is inserted and held by and between the regi-roller and a pinch roller in pressure contact with the regi-roller and, in this state, the regi-roller is rotated integrally with a drive shaft supporting the regi-roller, thereby feeding the sheet to the transfer position of the image.

Also, in feeding the sheet to the transfer position of the image, the rotation speed of the regi-roller is controlled, or, after the sheet is stopped provisionally at or before a position where the regi-roller is provided, a timing for removing the stop condition (that is, a sheet re-feed timing) is controlled, so that the leading end of the sheet can be made to reach the transfer position of the image at a good timing.

However, in the above-mentioned conventional image forming apparatus, in feeding the sheet to the image transfer position by the regi-roller, because the regi-roller becomes eccentric, that is, because the center of rotation of the regi-roller is shifted in position from the center of rotation of the drive shaft, when the leading end of the sheet arrives at the image transfer position, the required number of rotations of the regi-roller varies each time. That is, when the required number of rotations of the regi-roller varies each time, even if the rotation speed of the regi-roller is controlled or the sheet re-feed timing is controlled in the above-mentioned manner, in fact, the timing, at which the leading end of the sheet arrives at the image transfer position, varies from its expected timing, which makes it impossible to position or register the sheet with high accuracy.

Also, the eccentricity of the regi-roller depends on the working precision of the roller itself, the working precision of the drive shaft supporting the roller, and an assembling precision with which the regi-roller is fitted with the drive shaft; but, in fact, as a matter of course, there is a limit to enhancement of such precision. Therefore, in the conventional image forming apparatus, it is impossible to avoid the variations in the arriving timing of the sheet leading end at the image transfer position caused by the eccentricity of the regi-roller.

SUMMARY OF THE INVENTION

The present invention aims at eliminating the drawbacks found in the above-mentioned conventional image forming apparatus. Accordingly, it is an object of the invention to provide an image forming apparatus which allows the leading end of a sheet to reach the transfer position of an image at a desired timing free from the influence of the eccentricity of a regi-roller.

In attaining the above object, according to the first aspect of the invention, there is provided an image forming apparatus including: an image transfer unit disposed on the way of a sheet feed path; a sheet feed roller feeding a sheet toward an image transfer position where an image can be transferred by the image transfer unit; a sheet detect unit detecting the sheet fed by the sheet feed roller; and a control unit controlling the rotational operation of the sheet feed roller in accordance with the detect result of the sheet detect unit, wherein a sheet feed path length, which extends between the image transfer position and a detect position where the sheet is detected by the sheet detect unit, is set substantially at an integer multiple of a circumferential length of the sheet feed roller.

In this structure, since the sheet feed path length, which extends between the image transfer position for transfer of the image by the image transfer unit and the detect position of the sheet by the sheet detect unit, is set at an integer multiple of the circumferential length of the sheet feed roller, even if the sheet feed roller is eccentric, the required number of rotations of the sheet feed roller, from the time when the leading end of the sheet is detected by the sheet detect unit to the time when the leading end of the sheet arrives at the image transfer position, can be made always constant.

Also, according to the second aspect of the invention, there is provided an image forming apparatus including: an image transfer unit disposed on the way of a sheet feed path; a sheet feed roller feeding a sheet toward an image transfer position where an image can be transferred by the image transfer unit; and a stop unit stopping the sheet provisionally at a position of an upstream side from a provision position of the sheet feed roller on the sheet feed path, wherein a sheet feed path length, which extends between the image transfer position and the provision position, is set substantially at an integer multiple of the circumferential length of the sheet feed roller.

In this structure, since sheet feed path length, which extends between the image transfer position for transfer of the image by the image transfer unit and the provision position of the sheet feed roller, is set at an integer multiple of the circumferential length of the sheet feed roller, even if the sheet feed roller is eccentric, the required number of rotation of the sheet feed roller, until the leading end of the sheet stopped provisionally at the provision position of the sheet feed roller or on the upstream side thereof arrives at the image transfer position, can be made always constant.

Further, according to the third aspect of the invention, there is provided an image forming apparatus including: an image transfer unit disposed on the way of a sheet feed path; a sheet feed roller feeding a sheet toward an image transfer position where an image can be transferred by the image transfer unit; a first stop unit stopping said sheet provisionally while the rotation of said sheet feed roller is stopped; and a second stop unit stopping the sheet feed roller at a given rotation angle.

In this structure, since there is provided the second stop unit stopping the sheet feed roller at a given rotation angle, the rotation stop angle of the sheet feed roller when stopping the sheet provisionally can be set at a given angle. Thanks to this, even if the sheet feed roller is eccentric, the required number of rotation of the sheet feed roller, until the leading end of the sheet stopped provisionally by the sheet feed roller arrives at the image transfer position, can be made always constant.

DETAILED DESCRIPTION OF THE PREFERRED EMBODIMENTS

Now, description will be given below in detail of the preferred embodiments of an image forming apparatus according to the invention with reference to the accompanying drawings.

Figure 1:
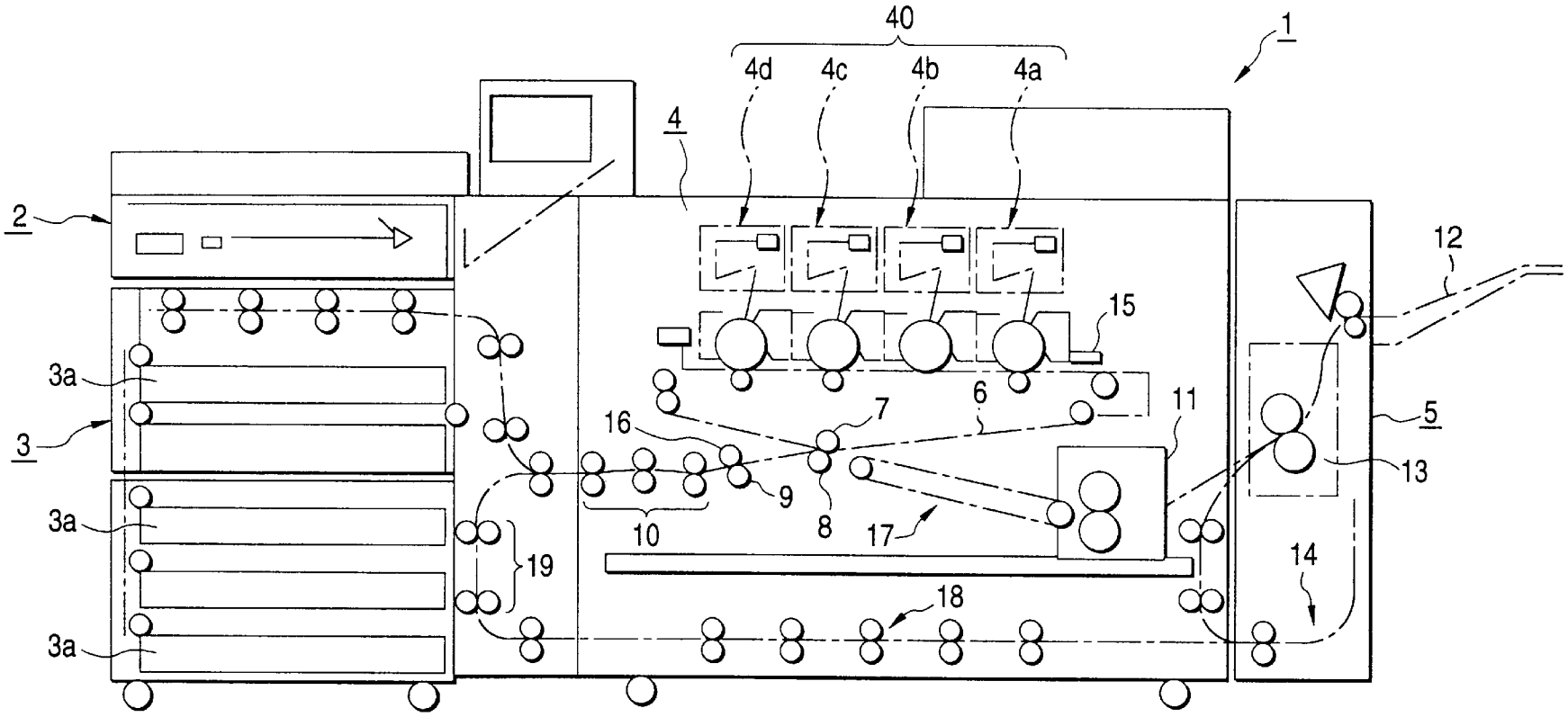
FIG. 1 is a schematic view of the structure of an image forming apparatus to which the invention is applied.

FIG. 1 is a schematic view of the structure of an image forming apparatus to which the present invention applies and, here, there is illustrated a digital composite machine which has both of a copy function and a printer function.

The illustrated digital composite machine 1 mainly includes an image read part 2, a sheet feed part 3, an image forming part 4, and a sheet discharge/invert part 5.

The image read part 2 is used to read optically an image of a manuscript placed on a manuscript support member and comprises, for example, a light source, a reflecting mirror, an image forming lens, a CCD sensor, and the like.

And, the sheet feed part 3 includes a plurality of sheet feed trays 3*a* respectively corresponding to the sizes and directions (vertical direction and transverse direction) of sheets, and a sheet feed system for feeding sheets sent out from the respective sheet feed trays 3*a*.

Also, the image forming part 4 is used to form an image on a sheet fed from the sheet feed part 3 and includes an image output unit 40 of a four-lined-drum type in which four image output portions 4*a* to 4*d* respectively composed of a photosensitive drum of a laser writing type and its peripheral devices (such as a charging device, a developing device, a transfer device, a cleaner, and the like) are disposed for each color. The image forming part 4 further includes an intermediate transfer belt 6 so provided as to extend along the positions of the photosensitive drums of the image output unit 40, a transfer roller 8 to be pressure contacted with a belt support roller 7 supporting the intermediate transfer belt 6, a regi-roller 9 for feeding a sheet toward the transfer position of an image to be transferred by the transfer roller 8 (that is, a position where the transfer roller 8 is pressure contacted with the belt support roller 7), a plurality of sheet register portions 10 disposed in front of (upstream of) the regi-roller 9 for registering or matching the side ends of the sheet to reference positions, and a fixing device 11 for fixing the toner image transferred to the sheet by the transfer roller 8.

And, the sheet discharge/invert part 5 includes a pair of discharge rollers 13 for discharging the sheet with a formed image and an inverting portion 14 for inverting the front and back surfaces of the sheet with an image formed on one of the surfaces.

In the digital composite machine 1 having the above-mentioned structure, based on an image signal read by the image read part 2 or an image signal received through a network or the like, toner images are respectively formed in the four image output portions 4*a*, 4*b*, 4*c* and 4*d* of the image output unit 40, and the thus formed toner images are then respectively transferred onto the intermediate transfer belt 6 while they are superimposed on top of one another, with the result that a color image is formed. In this color image forming operation, an image write operation into the photosensitive drum through laser writing is controlled based on a timing at which a mark bonded to a certain position on the side end of the intermediate transfer belt 6 is detected by a mark sensor 15.

On the other hand, a sheet, to which toner images (that is, a color image) are to be transferred, is sent out from the sheet feed tray 3*a* selected by hand or automatically and, after then, the sheet is fed into the image forming part 4 by the sheet feed system. When the sheet is fed into the image forming part 4, after the side ends of the sheet are matched to the reference positions by the sheet register portions 10, the sheet is inserted by and between the regi-roller 9 and a pinch roller 16 in pressure contact with the regi-roller 9. And, due to rotation of the regi-roller 9, the sheet is fed to the transfer position of the image, that is, the pressure contact portion between the belt support roller 7 and transfer roller 8, where the toner images (the color image) on the intermediate belt 6 are transferred to the sheet.

The sheet, to which the toner images have been transferred in this manner, is then fed to the fixing device 11 by a belt feed part 17, where the toner images on the sheet are fixed.

Here, in the case of one surface print, the sheet sent out from the fixing device 11 is delivered to the discharge roller 13 and, due to rotation of the discharge roller 13, the sheet is discharged out to a stack tray 12. On the other hand, in the case of double surface print, the front and back surfaces of the sheet sent out from the fixing device 11 are firstly inverted by the inverting portion 14 and, after then, the sheet is fed through a horizontal feed part 18 to a sheet wait part 19. On arriving at the sheet wait part 19, the sheet is stopped there provisionally and, after then, the sheet is fed again at a given timing and the double surfaces thereof are printed.

Figure 2:
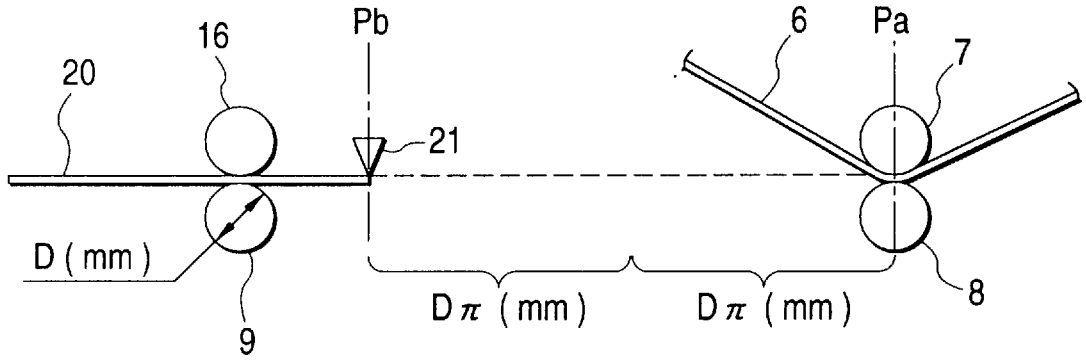
FIG. 2 is an explanatory view of a first embodiment of an image forming apparatus according to the invention.

Now, FIG. 2 is an explanatory view of a first embodiment of an image forming apparatus according to the invention.

In the first embodiment, on the sheet 20 discharge side (downstream side). that is formed by the regi-roller 9 and the pinch roller 16, there is disposed a sheet detect sensor 21 which is used as sheet detect means. As the sheet detect sensor 21, for example, there is used an optical sensor which consists of a combination of a light emitting element and a light receiving element.

On the other hand, between the belt support roller 7 and the transfer roller 8, there is inserted the intermediate transfer belt 6. And, in a pressure contact portion Pa between the belt support roller 7 and transfer roller 8, the images (toner images) are transferred from the intermediate transfer belt 6 to the sheet 20.

In the operation of the first embodiment, the leading end of the sheet 20 fed sequentially from the upstream side is inserted between the regi-roller 9 and the pinch roller 16 and, in this state, the sheet 20 is fed toward the transfer position Pa for transfer of the toner images by means of rotation of the regi-roller 9.

After then, if the leading end of the sheet 20 passes through a sheet detect position Pb where the sheet 20 can be detected by the sheet detect sensor 21, then the output signal (on/off signal) of the sheet detect sensor 21 is switched and, in accordance with the switching timing of the output signal, the rotational operation (acceleration and deceleration, re-feeding after stop) of the regi-roller 9 is controlled, thereby being able to adjust or control the arrival timing of the sheet 20 at the image transfer position Pa.

However, in this arrival timing control operation, when the regi-roller 9 is eccentric, even if the rotational operation of the regi-roller 9 is controlled in the above-mentioned manner, the arrival timing of the sheet leading end at the image transfer position Pa can vary from the expected timing due to the influence of the eccentricity of the regi-roller 9.

In view of the above, in the first embodiment, a sheet feed path length (which extends between the image transfer position Pa, where the toner images are transferred by the transfer roller 8, and the sheet detect position Pb where the leading end of the sheet 20 is detected by the sheet detect sensor 21) is set at an integer multiple of the circumferential length of the regi-roller 9.

In particular, as shown in FIG. 2, where D (mm) expresses the diameter of the regi-roller 9 and DΠ (mm) expresses the circumferential length of the regi-roller 9, the sheet feed path length between the transfer position Pa and detect position Pb is set double (DΠ +DΠ ) the circumferential length of the regi-roller 9.

Since the sheet feed path length between the image transfer position Pa and sheet detect position Pb is set in this manner, after the leading end of the sheet 20 is detected by the sheet detect sensor 21, even if the regi-roller 9 is eccentric, the leading end of the sheet 20 can be made to arrive at the image transfer position Pa at a time when the regi-roller 9 rotates just twice. That is, the required number of rotations of the regi-roller 9, from the time when the leading end of the sheet 20 passes through the sheet detect position Pb to the time when it arrives at the image transfer position Pa, can be made always constant. Due to this, the leading end of the sheet 20 can be made to arrive at the image transfer position Pa at a desired timing free from the influence of the eccentricity of the regi-roller 9.

By the way, in FIG. 2, in the middle portion of the sheet feed path extending from the regi-roller 9 to the transfer roller 8, there is disposed a single sheet detect sensor 21. However, besides this, as an application thereof, it is also possible to employ such a structure as shown in FIG. 3.

Figure 3:
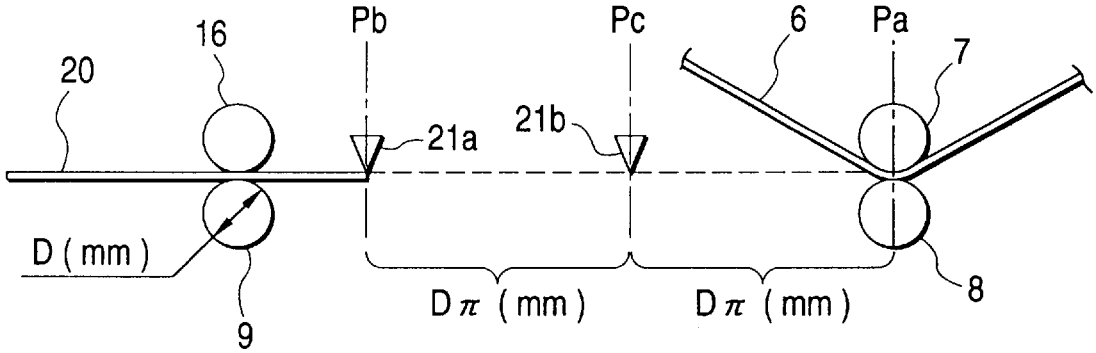
FIG. 3 is an explanatory view of an application of the first embodiment of the invention.

That is, in FIG. 3, there is employed a structure in which, in the middle portion of the sheet feed path extending from the regi-roller 9 to the transfer roller 8, there are disposed two pieces of sheet detect sensors 21*a* and 21*b*. Among them, one sheet detect sensor 21*a* is used to detect the leading end of the sheet at a position Pb shown in FIG. 3, whereas the other sheet detect sensor 21*b* is used to detect the leading end of the sheet at a position Pc existing downstream of the position Pb. And, in the present application, a sheet feed path length (which extends between the image transfer position Pa, where the toner images are transferred by the transfer roller 8, and the sheet detect position Pb where leading end of the sheet 20 is detected by one sheet detect sensor 21*a*) is set double (DΠ +DΠ ) the circumferential length of the regi-roller 9; whereas, a sheet feed path length (which extends between the image transfer position Pa, where the toner images are transferred by the transfer roller 8, and the sheet detect position Pc where leading end of the sheet 20 is detected by the other sheet detect sensor 21*b*) is set equal to the circumferential length of the regi-roller 9, that is, equal to DΠ .

In the present applied structure, if the leading end of the sheet 20 fed by means of the rotational movement of the regi-roller 9 passes through the detect position Pb for the sheet detect sensor 21*a* located on the upstream side, then the output signal of the sheet detect sensor 21*a* is switched; and, if the leading end of the sheet 20 passes through the detect position Pc for the sheet detect sensor 21*b* located on the downstream side, then the output signal of the sheet detect sensor 21*b* is switched.

In the above operation, after the leading end of the sheet 20 is detected by the sheet detect sensor 21*a,* even if the regi-roller 9 is eccentric, the leading end of the sheet 20 can be made to arrive at the detect position Pc for the sheet detect sensor 21*b* at a time when the regi-roller 9 rotates once; and, at a time when the regi-roller 9 rotates once more, the leading end of the sheet 20 can be made to arrive at the image transfer position Pa. Also, the arrival timing of the sheet leading end at the image transfer position Pa is adjusted roughly by controlling the rotation operation of the regi-roller 9 in accordance with the switching timing of the output signal of the upstream side sheet detect sensor 21*a,* and is further adjusted finely by controlling the rotation operation of the regi-roller 9 in accordance with the switching timing of the output signal of the downstream side sheet detect sensor 21*b*. Due to this, the influence of the eccentricity of the regi-roller 9 can be avoided and thus, the arrival timing of the sheet leading end at the image transfer position Pa can be adjusted with high accuracy.

Figure 4:
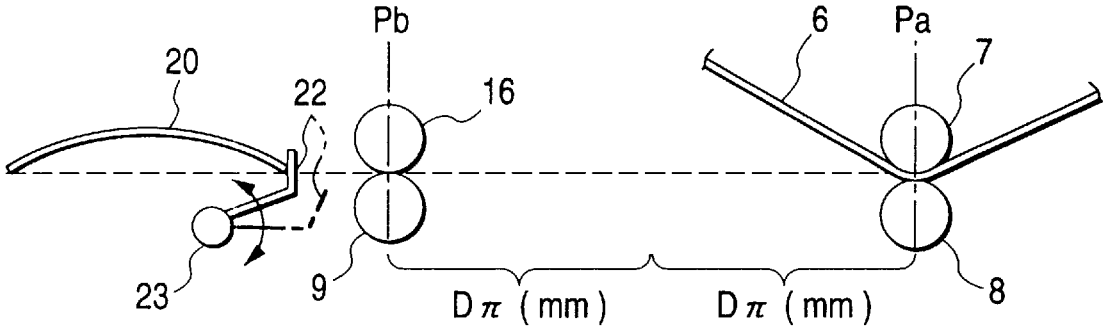
FIG. 4 is an explanatory view of a second embodiment of an image forming apparatus according to the invention.

Now, FIG. 4 is an explanatory view of a second embodiment of an image forming apparatus according to the invention.

In the second embodiment, the same components thereof as in the previously described first embodiment are given like reference characters and thus the duplicate description thereof is omitted here.

In the second embodiment, on the sheet intake side (upstream side) where the sheet 20 is taken in by and between the regi-roller 9 and pinch roller 16, there is disposed a gate member 22 which is used as stop means. The gate member 22 is supported by a support shaft 23 in such a manner that it can be swung in a direction of an arrow shown in FIG. 4 and, in accordance with the rotational operation of the support shaft 23, the gate member 22 is allowed to operate between a position (which is shown by a solid line in FIG. 4) where the gate member 22 advances into the sheet feed path and a position (which is shown by a broken line in FIG. 4) where the gate member 22 retreats from the sheet feed path.

In the operation of the second embodiment, with respect to the sheet 20 sequentially fed from the upstream side, the gate member 22 waits for the sheet 20 while it advances to and stays in the sheet feed path. At a time when the leading end of the sheet 20 is butted against the gate member 22 to thereby produce a given loop, the feeding operation of the sheet 20 on the upstream side is stopped provisionally. At the then time, the regi-roller 9 is rotating at a given speed and, in accordance with the rotation of the regi-roller 9, the pinch roller 16 is also rotating.

Next, to a timing when the toner images carried on the intermediate transfer belt 6 arrive at the image transfer position Pa, the gate member 22 retreats from the sheet feed path. As a result of this, the leading end of the sheet 20 is taken in by and between the regi-roller 9 and pinch roller 16 due to the pressure of the above loop and, after then, the sheet 20 is fed to the image transfer position Pa by means of the rotational movement of the regi-roller 9.

In the above operation, when the regi-roller 9 is eccentric, then even if the re-feeding timing of the sheet 20 is controlled in the above-mentioned manner, under the influence of the eccentricity of the regi-roller 9, the arrival timing of the leading end of the sheet at the image transfer position Pa is caused to vary from its expected timing.

In view of this, in the second embodiment, a sheet feed path length between the image transfer position Pa, where the toner images are transferred by the transfer roller 8, and the position Pb where the regi-roller 9 is provided (that is, a roller pressure contact portion) is set at an integer multiple of the circumferential length of the regi-roller 9.

In particular, as shown in FIG. 4, where D (mm) expresses the diameter of the regi-roller 9 and DΠ (mm) expresses the circumferential length of the regi-roller 9, the sheet feed path length between the transfer position Pa and roller provision position Pb is set double (DΠ +DΠ ) the circumferential length of the regi-roller 9.

Since the sheet feed path length between the image transfer position Pa and regi-roller 9 provision position Pb is set in this manner, after the leading end of the sheet 20 is taken in by and between the regi-roller 9 and the pinch roller 16, even if the regi-roller 9 is eccentric, the leading end of the sheet 20 can be made to arrive at the image transfer position Pa at a time when the regi-roller 9 rotates just twice. That is, the required number of rotations of the regi-roller 9, from the time when the leading end of the sheet 20 passes through the sheet provision position Pb to the time when it arrives at the image transfer position Pa, can be made always constant.

Thanks to this, the leading end of the sheet 20 can be made to arrive at the image transfer position Pa at a desired timing free from the influence of the eccentricity of the regi-roller 9.

Figure 5:
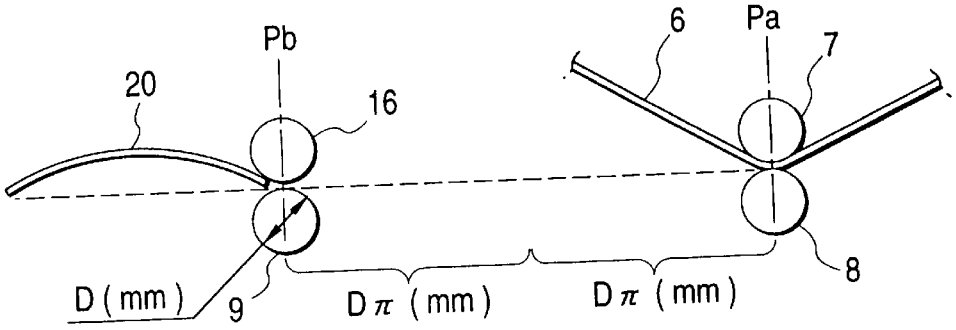
FIG. 5 is an explanatory view of a modification of the second embodiment of the invention.

By the way, in FIG. 4, there is employed the structure in which the gate member 22 is disposed on the upstream side of the regi-roller 9 and the sheet 20 is stopped provisionally in front of the regi-roller 9 by the gate member 22. However, this is not limitative but, for example, there can be employed such a structure as shown in FIG. 5 in which, with respect to the sheet 20 sequentially fed from the upstream side, the regi-roller 9 is made to wait while it is stopped, whereby the sheet 20 can be stopped provisionally at the provision position Pd of the regi-roller 9. That is, even when this structure is employed, if the sheet feed path length between the image transfer position Pa and regi-roller 9 provision position Pb is set at an integer multiple of (in FIG. 5, double) the circumferential length of the regi-roller 9, then a similar effect can be obtained.

By the way, in the above-mentioned first and second embodiments, since the pinch roller 16 is a roller which can be rotated in accordance with the movement of the sheet 20 fed by means of the rotational movement of the regi-roller 9, the circumferential length of the pinch roller 16 can be set arbitrarily.

Figure 6A:
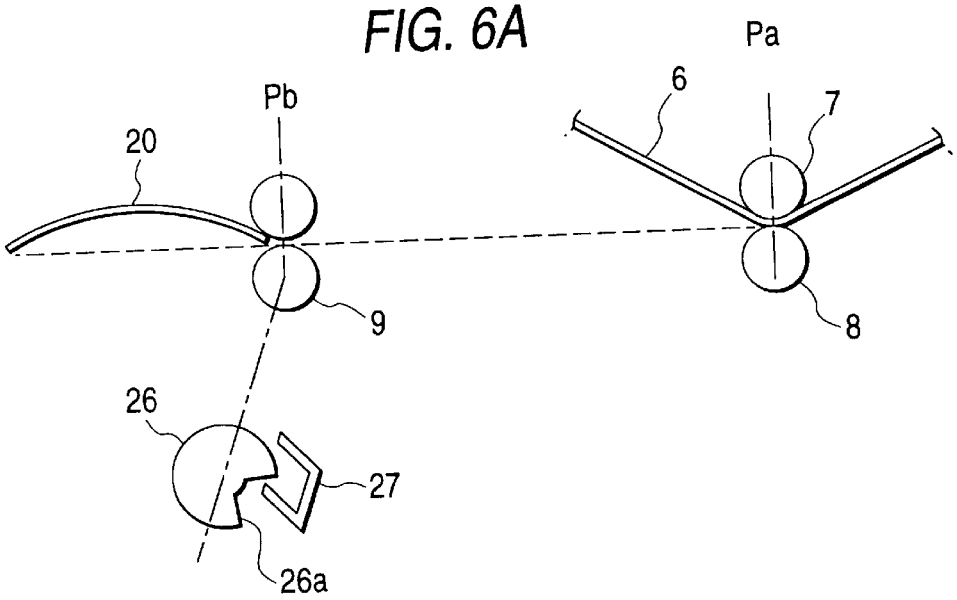
FIG. 6A and 6B are explanatory views of a third embodiment of an image forming apparatus according to the invention.
Figure 6B:
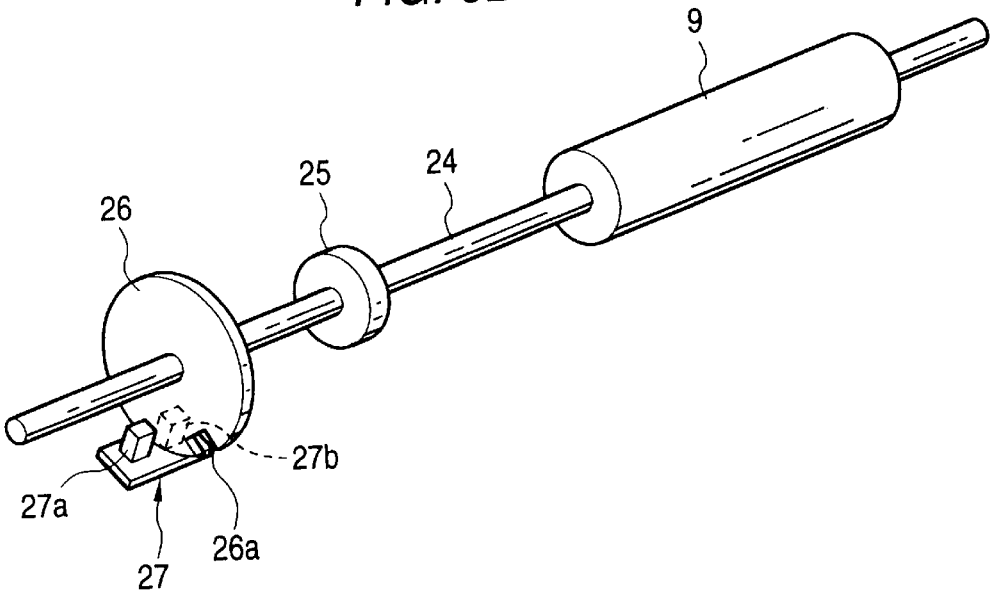

Now, FIGS. 6A and 6B are an explanatory view of a third embodiment of an image forming apparatus according to the invention; in particular, FIG. 6A is a schematic view of the third embodiment and FIG. 6B is a perspective view of the main portions of the third embodiment.

By the way, in the third embodiment as well, similar components to the previously described first and second embodiments are given like reference characters and thus the duplicate description thereof is omitted here.

In the third embodiment, a drive shaft 24, which is fitted with the regi-roller 9, is rotatably supported by a bearing 25. Also, the drive shaft 24 can be rotationally driven by a drive motor (not shown) and, on one end side thereof, there are provided a thin-plate-shaped disk 26 and a rotation detect sensor 27 in such a manner that they are adjacent to each other.

The disk 26 is mounted on the same drive shaft 24 as the regi-roller 9, while the regi-roller 9 and disk 26 can be rotated integrally with the drive shaft 24. Also, in the outer peripheral portion of the disk 26, there is formed a cutaway portion 26*a*. On the other hand, the rotation detect sensor 27 is an optical sensor including, for example, a light emitting element 27*a* and a light receiving element 27*b* which are disposed opposed to and spaced from each other by a given distance, while the outer peripheral portion of the disk 26 is inserted in part between the light emitting element 27*a* and light receiving element 27*b*.

In the operation of the third embodiment, the regi-roller 9 is stopped at a given rotation angle (which will be discussed later) with respect to the sheet 20 sequentially fed from the upstream side; and, at a time when the leading end of the sheet 20 is butted against the provision position Pb of the thus rotation-stopped regi-roller 9 (that is, the pressure contact portion between the regi-roller 9 and pinch roller 16) to thereby produce a given loop, the feeding of the sheet 20 on the upstream side is stopped provisionally.

Next, so as to match with a timing when the toner images carried on the intermediate transfer belt 6 arrive at the image transfer position Pa, the rotation of the regi-roller 9 is started and, by means of the rotational movement of the regi-roller 9, the sheet 20 is fed to the image transfer position Pa.

After then, the rotational movement of the regi-roller 9 will be stopped in preparation for arrival of the following sheet fed from the upstream side; in particular, in the present embodiment, the rotational movement of the regi-roller 9 is stopped in accordance with the switching timing of the output signal of the rotation detect sensor 27.

Referring in more detail to this, the output signal of the rotation detect sensor 27 is switched at the moment the cutaway portion 26*a* of the disk 26 rotating integrally with the regi-roller 9 passes through the optical axis of the rotation detect sensor 27. Accordingly, at the same time as the switching timing of the output signal of the rotation detect sensor 27 or after the passage of a given time from the present switching timing, the driving of the drive motor (not shown) is stopped.

Due to this, the regi-roller 9 can be made to always stop at a given rotation angle and wait for arrival of the sheet in this stopped condition. Therefore, even if the regi-roller 9 is eccentric, the required number of rotations of the regi-roller 9, from the time when the leading end of the sheet 20 arrives at the provision position Pb of the regi-roller 9 to the time when the leading end of the sheet 20 arrives at the image transfer position Pa due to the rotational movement of the regi-roller 9, can be made always constant. That is, similarly to the previously described first and second embodiments, the leading end of the sheet 20 can be made to arrive at the image transfer position Pa at a desired timing free from the influence of the eccentricity of the regi-roller 9.

By the way, in the above-mentioned third embodiment, as the means for stopping the regi-roller 9 at a given rotation angle, there is employed the detection mechanism in which the disk 26 is mounted on the same shaft (that is, drive shaft 24) as the regi-roller 9 and the passage of the cutaway portion 26*a* of the disk 26 is detected by the rotation detect sensor 27. However, this is not limitative but, for example, the detection mechanism may be mounted on the rotation shaft of the pinch roller 16 which rotates together with the regi-roller 9, or it may be mounted on the motor shaft of a drive motor for rotationally driving the drive shaft 24, or it may be incorporated into a drive transmission system (gear train or the like) for transmitting the drive motor rotation force to the drive shaft 24.

Also, in the first, second and third embodiments described hereinbefore, description has been given of the application of the invention to the image forming apparatus structured such that the toner images carried on the intermediate transfer belt 6 are transferred to the sheet 20 at the image transfer position Pa by the transfer roller 8. However, the invention is not limited to this but, for example, the invention can also apply similarly to an image forming apparatus structured such that toner images formed on a photosensitive drum are transferred to a sheet at an image transfer position by a transfer device, or to an image forming apparatus structured such that toner images formed on a photosensitive drum are transferred to a sheet at an image transfer position by a transfer roller, or to other similar image forming apparatus.

In addition, the wording "at an integer multiple" described in the above embodiments may be set so as to be "substantially at an integer multiple".

As has been described heretofore, with use of an image forming apparatus according to the first aspect of the invention, since the sheet feed path length, which extends between the image transfer position for transfer of the image by the image transfer means and the detect position of the sheet by the sheet detect means, is set at an integer multiple of the circumferential length of the sheet feed roller, the required number of rotations of the sheet feed roller, from the time when the leading end of the sheet is detected by the sheet detect means to the time when the leading end of the sheet arrives at the image transfer position, can be made always constant. This allows the leading end of the sheet to arrive at the image transfer position at a desired timing free from the influence of the eccentricity of the sheet feed roller, which in turn can realize the position registration of the sheet with high accuracy.

Also, with use of an image forming apparatus according to the second aspect of the invention, since sheet feed path length, which extends between the image transfer position for transfer of the image by the image transfer means and the provision position of the sheet feed roller, is set at an integer multiple of the circumferential length of the sheet feed roller, the required number of rotation of the sheet feed roller, until the leading end of the sheet stopped provisionally at the provision position of the sheet feed roller or on the upstream side thereof arrives at the image transfer position, can be made always constant. This structure, similarly to the above structure, allows the leading end of the sheet to arrive at the image transfer position at a desired timing free from the influence of the eccentricity of the sheet feed roller, which in turn can realize the position registration of the sheet with high accuracy.

Further, with use of an image forming apparatus according to the third aspect of the invention, by stopping the sheet feed roller at a given rotation angle, the required number of rotation of the sheet feed roller, until the leading end of the sheet stopped provisionally by the sheet feed roller arrives at the image transfer position, can be made always constant. This structure, similarly to the above structures, allows the leading end of the sheet to arrive at the image transfer position at a desired timing free from the influence of the eccentricity of the sheet feed roller, which in turn can realize the position registration of the sheet with high accuracy.

The entire disclosure of each and every foreign patent application from which the benefit of foreign priority has been claimed in the present application is incorporated herein by reference as if fully set forth.

While only certain embodiment of the invention have been specifically described herein, it will apparent that numerous modifications may be made thereto without departing from the spirit and scope of the invention.

What is claimed is:

1. An image forming apparatus comprising:

image transfer means disposed on the way of a sheet feed path;

a sheet feed roller feeding a sheet toward an image transfer position where an image can be transferred by said image transfer means;

sheet detect means detecting said sheet fed by said sheet feed roller; and control means controlling the rotational operation of said sheet feed roller in accordance with the detect result of said sheet detect means, wherein a sheet feed path length, which extends between said image transfer position and a detect position where said sheet is detected by said sheet detect means, is set substantially at an integer multiple of a circumferential length of said sheet feed roller.

2. An image forming apparatus according to claim 1, wherein said sheet detect means includes a plurality of said sheet detect means, and each of the plurality of said sheet detect means is set at a position of an integer multiple of the circumferential length of said sheet feed roller from said image transfer position.

3. An image forming apparatus comprising:

image transfer means disposed on the way of a sheet feed path;

a sheet feed roller feeding a sheet toward an image transfer position where an image can be transferred by said image transfer means; and stop means stopping said sheet provisionally at a position of an upstream side from a provision position of said sheet feed roller on said sheet feed path, wherein a sheet feed path length, which extends between said image transfer position and said provision position, is set substantially at an integer multiple of the circumferential length of said sheet feed roller.

4. An image forming apparatus according to claim 3, wherein said stop means stops the sheet provisionally at said provision position.

5. An image forming apparatus comprising:

image transfer means disposed on the way of a sheet feed path;

a sheet feed roller having a provision position, said sheet feed roller feeding a sheet toward an image transfer position where an image can be transferred by said image transfer means to the sheet;

first stop means stopping said sheet provisionally while the rotation of said sheet roller is stopped; and second stop means stopping said sheet feed roller at a given rotation angle, wherein the sheet feed path has a length extending between said provision position of said sheet feed roller and said image transfer position set substantially at an integer multiple of a circumferential length of said sheet feed roller.

6. An image forming apparatus according to claim 5, wherein said second stop means comprises:

rotating means rotating in conjunction with a rotation of said sheet feed roller and having a detected point corresponding to the given rotation angle; and detecting means detecting the detected point.

7. An image forming apparatus according to claim 6, wherein said rotating means is a disk coaxially provided with said sheet feed roller, said detected point is a cutaway portion provided in said disk, and said detecting means has a light emitting element and a light receiving element which detect the cutaway portion of the disk.

* * * * *